US007814982B2

(12) United States Patent
Moyes

(10) Patent No.: US 7,814,982 B2
(45) Date of Patent: Oct. 19, 2010

(54) DOWNHOLE NON-RETURN VALVE AND METHOD

(75) Inventor: Peter Barnes Moyes, Gallow Brace Torphws (GB)

(73) Assignee: Baker Hughes Incorporated, Houston, TX (US)

( * ) Notice: Subject to any disclaimer, the term of this patent is extended or adjusted under 35 U.S.C. 154(b) by 149 days.

(21) Appl. No.: 11/491,699

(22) Filed: Jul. 24, 2006

(65) Prior Publication Data

US 2007/0034377 A1 Feb. 15, 2007

(30) Foreign Application Priority Data

Jul. 22, 2005 (GB) ..... 0515071.9

(51) Int. Cl.
*E21B 34/06* (2006.01)
*E21B 34/00* (2006.01)
*E21B 33/00* (2006.01)

(52) U.S. Cl. ..... 166/373; 166/325; 166/386; 166/321; 166/334.4

(58) Field of Classification Search ..... 166/373, 166/384, 386, 321, 320, 334.4, 325; 137/516.25, 137/516.27
See application file for complete search history.

(56) References Cited

U.S. PATENT DOCUMENTS 2,358,228 A * 9/1944 Hoof ..... 137/113
2,781,774 A * 2/1957 Baker et. al. ..... 137/493.2
3,054,422 A * 9/1962 Napolitano ..... 137/509
3,086,593 A 4/1963 Chitwood ..... 166/224
3,311,127 A 3/1967 Dudley ..... 137/155
3,604,451 A * 9/1971 Delamater ..... 137/512.15
3,776,250 A * 12/1973 Knox ..... 137/71
3,814,181 A * 6/1974 Young ..... 166/324
4,121,619 A * 10/1978 Pauliukonis ..... 137/469
4,360,064 A * 11/1982 O'Connor et al. ..... 166/319
4,473,231 A * 9/1984 Tilton et al. ..... 277/342
5,320,181 A * 6/1994 Lantier et al. ..... 166/386
5,501,280 A * 3/1996 Brisco ..... 166/373
6,220,359 B1 * 4/2001 Poulard ..... 166/373
6,263,969 B1 * 7/2001 Stoesz et al. ..... 166/334.4
6,446,613 B1 * 9/2002 Djordjevic ..... 123/514
6,585,048 B1 * 7/2003 Heijnen ..... 166/325

(Continued)

FOREIGN PATENT DOCUMENTS

GB 2 099 483 A 4/1982

(Continued)

OTHER PUBLICATIONS

International Search Report. PCT/EP 03/11250. Aug. 17, 2004. Reference No. PCT/US2006/028322.

(Continued)

*Primary Examiner*—Kenneth Thompson
*Assistant Examiner*—Cathleen R Hutchins
(74) *Attorney, Agent, or Firm*—Cantor Colburn LLP

(57) ABSTRACT

Disclosed herein is a device that relates to a non-return valve. The valve comprising, a valve seat, a valve piston in operable communication with the valve seat. The valve further comprising, a first seal disposed at the piston to interact with the valve seat, and a second seal positioned at the piston to interact with the valve seat temporally after the first seal.

23 Claims, 9 Drawing Sheets

U.S. PATENT DOCUMENTS

| | | | | |
|---|---|---|---|---|
| 6,666,273 | B2 * | 12/2003 | Laurel | 166/382 |
| 6,695,049 | B2 * | 2/2004 | Ostocke et al. | 166/97.1 |
| 6,702,024 | B2 * | 3/2004 | Neugebauer | 166/321 |
| 6,820,697 | B1 * | 11/2004 | Churchill | 166/374 |
| 6,896,049 | B2 | 5/2005 | Moyes | |
| 6,973,974 | B2 | 12/2005 | McLoughlin et al. | 166/386 |
| 7,108,071 | B2 * | 9/2006 | Freiheit et al. | 166/373 |
| 7,225,830 | B1 * | 6/2007 | Kershaw | 137/512.1 |
| 2002/0074134 | A1 * | 6/2002 | Cook et al. | 166/383 |
| 2003/0098163 | A1 * | 5/2003 | Hebert et al. | 166/381 |

FOREIGN PATENT DOCUMENTS

| | | | |
|---|---|---|---|
| WO | WO 2004/101950 | A1 | 11/2004 |

OTHER PUBLICATIONS

Ramos-Candelaria, Mayflor, et al. Calcite Inhibition Field Trials at the Mindanao Geothermal Production Field (MGPF), Philippines, Proceedings World Geothermal Congress 2000: Kyushu-Yohoku, Japan, May 28-Jun. 10, 2000.

Water Injection with the High Lift Injection Valve, Redspider Technology, 6 pages, Copyright 2007. Retrieved online on Sep. 17, 2008 from: http://www.redspiders.com/products/injection_valve_specialists.htm.

Tubing-Retrievable Chemical-Injection Valve, Weatherford International, Ltd., 2 pages. Copyright 2005. Retrieved online on Sep. 17, 2008 from: http://www.redspiders.com/products/injection_valve_specialists.htm.

Water Injection Valve, Omega Completion Technology, Ltd., 2 pages, Mar. 11, 2008.

* cited by examiner

DOWNHOLE NON-RETURN VALVE AND METHOD

CROSS REFERENCE TO RELATED APPLICATIONS

This application claims priority to G.B. provisional application, 0515071.9, filed Jul. 22, 2005, the entire contents of which are incorporated herein by reference.

FIELD OF THE INVENTION

The present invention relates to a non-return valve and particularly to a non-return injection valve for use downhole.

BACKGROUND OF THE INVENTION

Injection valves are used where an operator wishes to inject a fluid into a pressurized downhole environment. The fluid may, for example, be water or gas which is to be injected into the formation to maintain reservoir pressure.

Some conventional injection valves comprise a plug biased by a spring to a position in which the valve outlet is sealed closed. To inject fluid through the valve, the fluid is pressurized against the plug until there is sufficient fluid pressure to overcome the closing force of the spring, permitting the valve to open.

There are disadvantages associated with this type of arrangement. For example, when the fluid pressure has built up sufficiently to overcome the spring closing force, and the plug moves to open the outlet, there is an immediate release of pressure as fluid flows through the valve. In this situation the fluid pressure can drop sufficiently to permit the valve to close under the action of the spring. The pressure then builds up behind the plug and an oscillation cycle of valve opening and closing can be established. This oscillation cycle causes vibration in the string and can lead to damage of the sealing interface between the plug and the valve housing. Additionally, as the plug is opened, and the pressurized fluid passes between the plug and the housing, the movement of the fluid can erode the valve and the surrounding components such as the bore casing or tubing.

It is an object of the present invention to obviate or mitigate at least one of the aforementioned disadvantages.

BRIEF DESCRIPTION OF THE INVENTION

Disclosed herein is a device that relates to a non-return valve. The valve comprising, a valve seat, a valve piston in operable communication with the valve seat. The valve further comprising, a first seal disposed at the piston to interact with the valve seat, and a second seal positioned at the piston to interact with the valve seat temporally after the first seal.

Further disclosed herein is a downhole non-return valve. The non-return valve comprising, a housing defining a valve inlet and a valve outlet, a plug moveable between an open position and a fully sealed position. Additionally comprising a biasing member urging the plug towards the fully sealed position wherein the urging force of the biasing member is sufficient to move the plug to a partially sealed position but is selected to be insufficient to move the plug to a fully sealed position.

Further disclosed herein relates to a downhole non-return valve. The valve comprising, a housing defining a valve inlet and valve outlet, and a plug moveable between an open position and a fully closed position. The valve further comprising a sacrificial member adapted to divert fluid injected through the valve axially along an external surface of the valve housing.

Further disclosed herein is a method that relates to injection fluid into a well bore through a non-return valve. The method comprising, injecting fluid into a non-return valve the valve being in a fully sealed configuration, pressurizing the fluid sufficiently to overcome a closing force comprising a combination of a biasing force and well pressure to open a valve outlet. The method further comprising, injecting fluid through the valve outlet into a well and ceasing injection of the fluid thereby permitting the closing force to fully seal the valve outlet.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
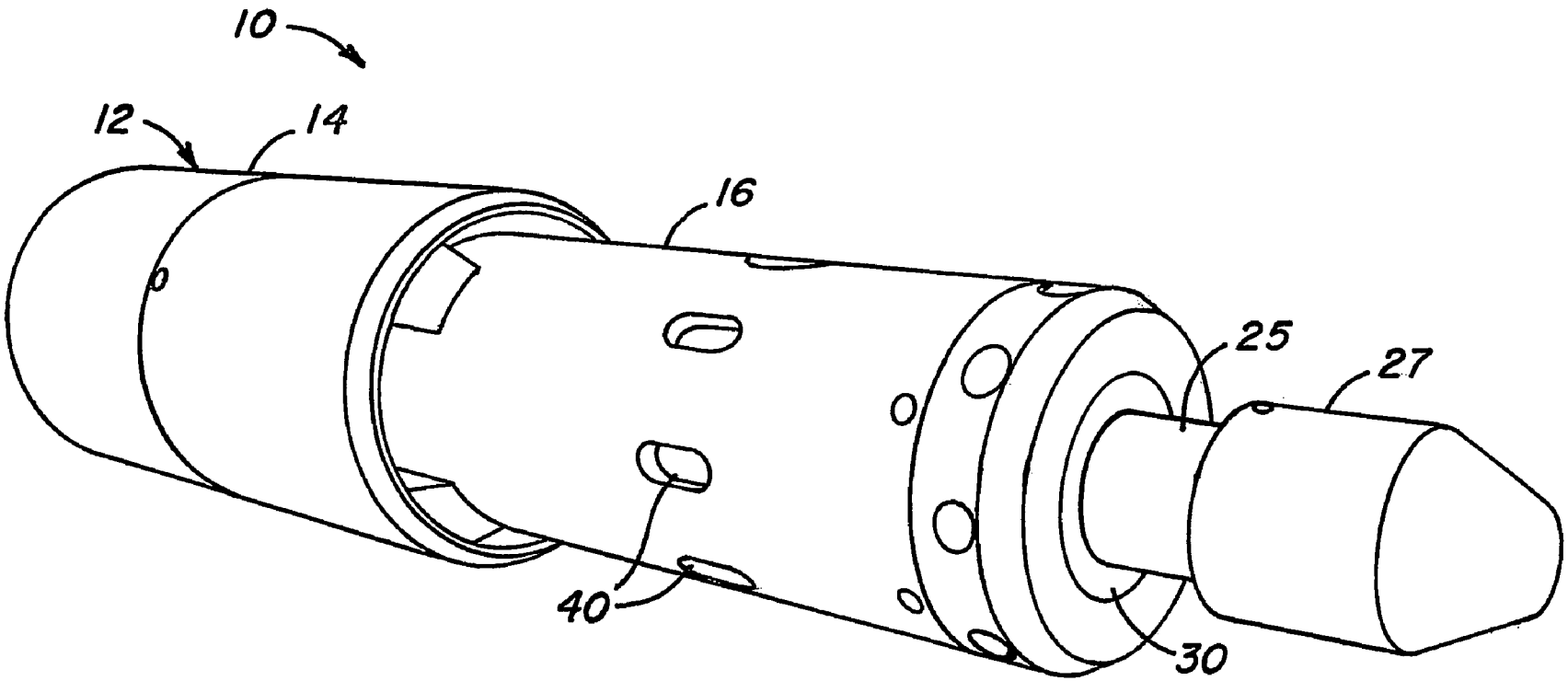
FIG. 1 is a perspective view of a non-return injection valve in the run-in configuration according to an embodiment of the present invention.
Figure 2:
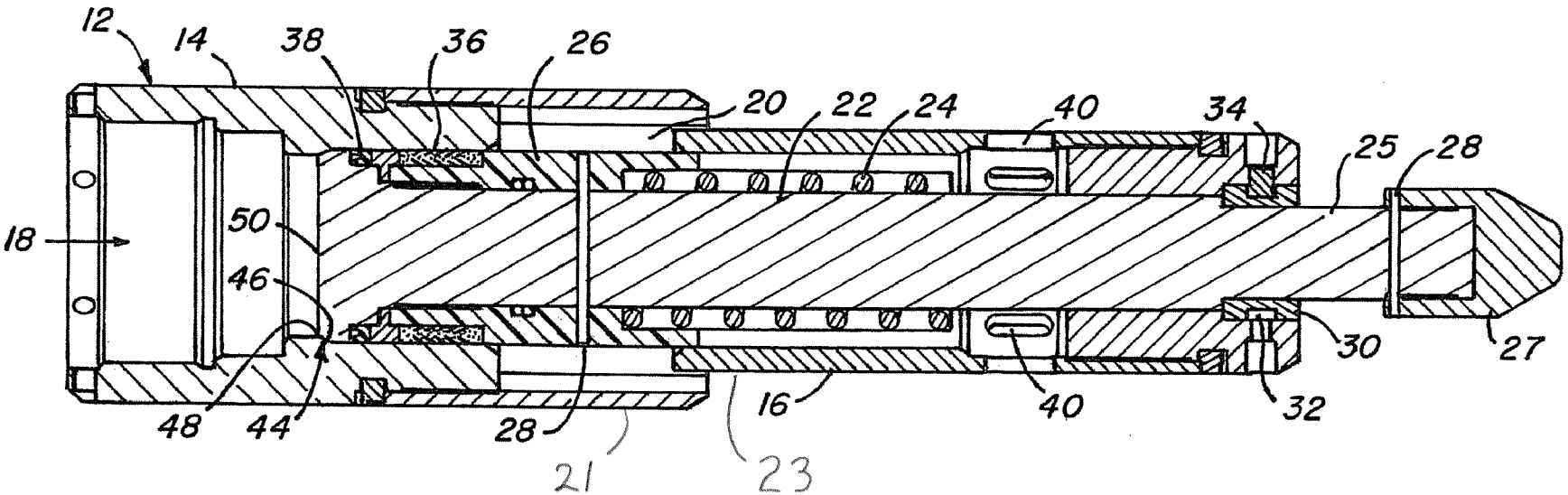
FIG. 2 is a cross-sectional side view of the valve of FIG. 1 in the run-in configuration.

Referring firstly to FIG. 1, there is shown a perspective view of a non-return injection valve generally indicated by reference numeral 10 in a run-in-configuration according to an embodiment of the present invention. The internal arrangement of the injection valve 10 can be seen more clearly with reference to FIG. 2, a cross-sectional side view of the non-return injection valve 10 of FIG. 1 in the run-in-configuration.

The valve 10 comprises a housing 12 having an upper housing portion 14 and a lower housing portion 16. The housing 12 defines a housing inlet 18 and a housing outlet 20. The housing outlet 20 is partially covered by a sacrificial shield 21.

Contained within the housing 12 is an injection valve plug 22 and a spring 24. The plug 22 comprises a shaft 25, a packing mandrel 26 and an end cap 27. The packing mandrel 26 and the end cap 27 are fixed to the shaft 25 by means of rivet pins 28.

The plug 22 further comprises a shear screw ring 30 defining a groove 32, which is adapted to receive a number of shear pins 34 of which only one is shown for clarity. The shear pins 34 secure the valve 10 in the run-in-configuration during transit and location downhole and permit a pressure application to a pre-determined rate to test the correct placement and setting of the hanging device.

The sacrificial shield 21 diverts the flow of fluid from the outlets 20 axially along the external surface 23 of the lower housing portion 16. This prevents erosion of the surrounding bore casing (not-shown) and ensures that any erosion which occurs will take place on the sacrificial shield 21.

Finally, the lower housing portion 16 defines well fluid inlet ports 40, the purpose of which will be discussed in due course.

Figure 3:
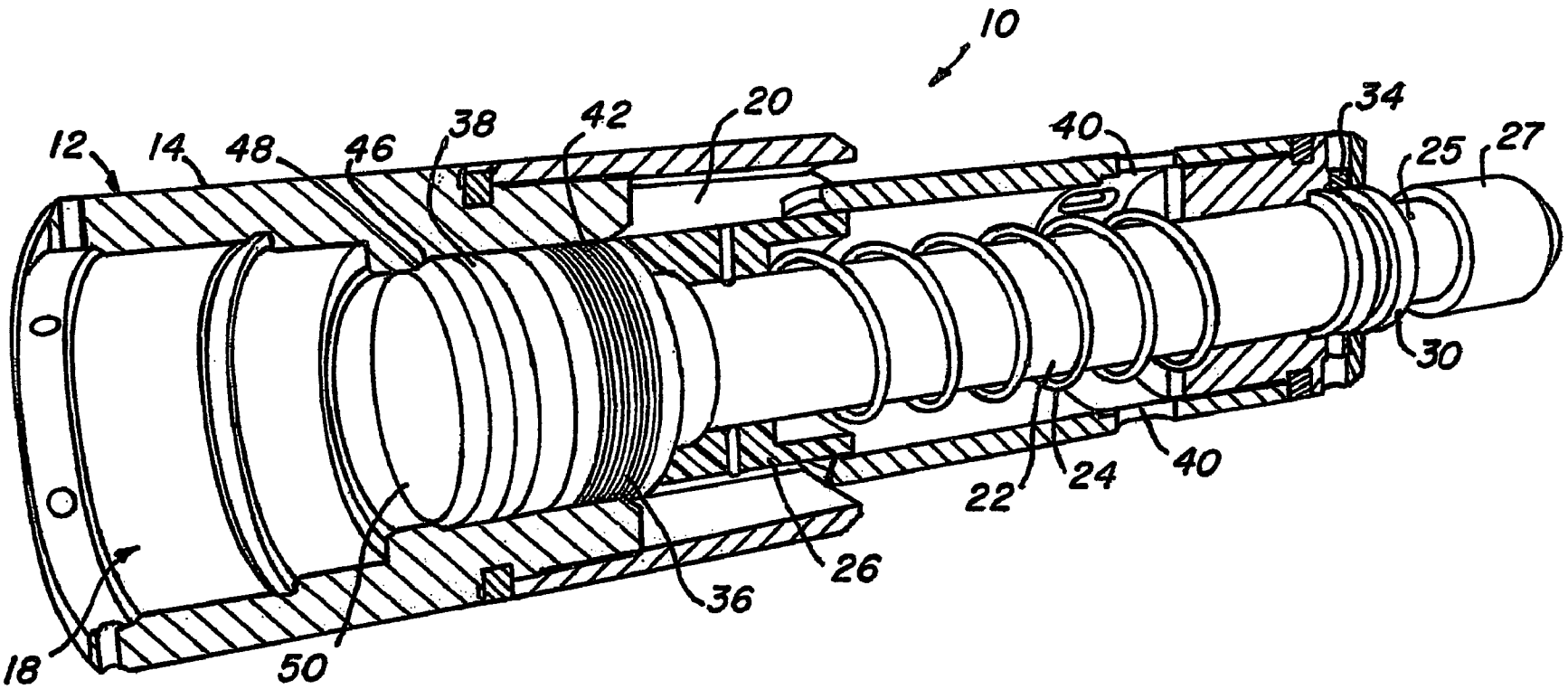
FIG. 3 is a partially cut-away perspective view of the valve of FIG. 1 shown in the run-in configuration.

Referring now to FIG. 3, there is shown a partially cut away perspective view of the non-return injection valve 10 of FIG. 1 shown in the run-in configuration. As can be seen from this Figure, the plug 22 is located in the fully sealed position in that the plug 22 is preventing fluid from flowing between the housing inlet 18 and the housing outlet 20. In this configuration, both the wiper seal 38 and the V-packing seal 36 engage an internal surface 42 of the upper housing portion 14 and the seal surface 46 engages the seal seat 48. Additionally, the shear screws 34 are shown engaged with the shear screw ring 30.

As fluid is pumped into the valve 10, the pressure being applied to the plug face 50 increases to a point when the pressure is sufficient to shear the screws 34 and move the plug 22.

Figure 4:
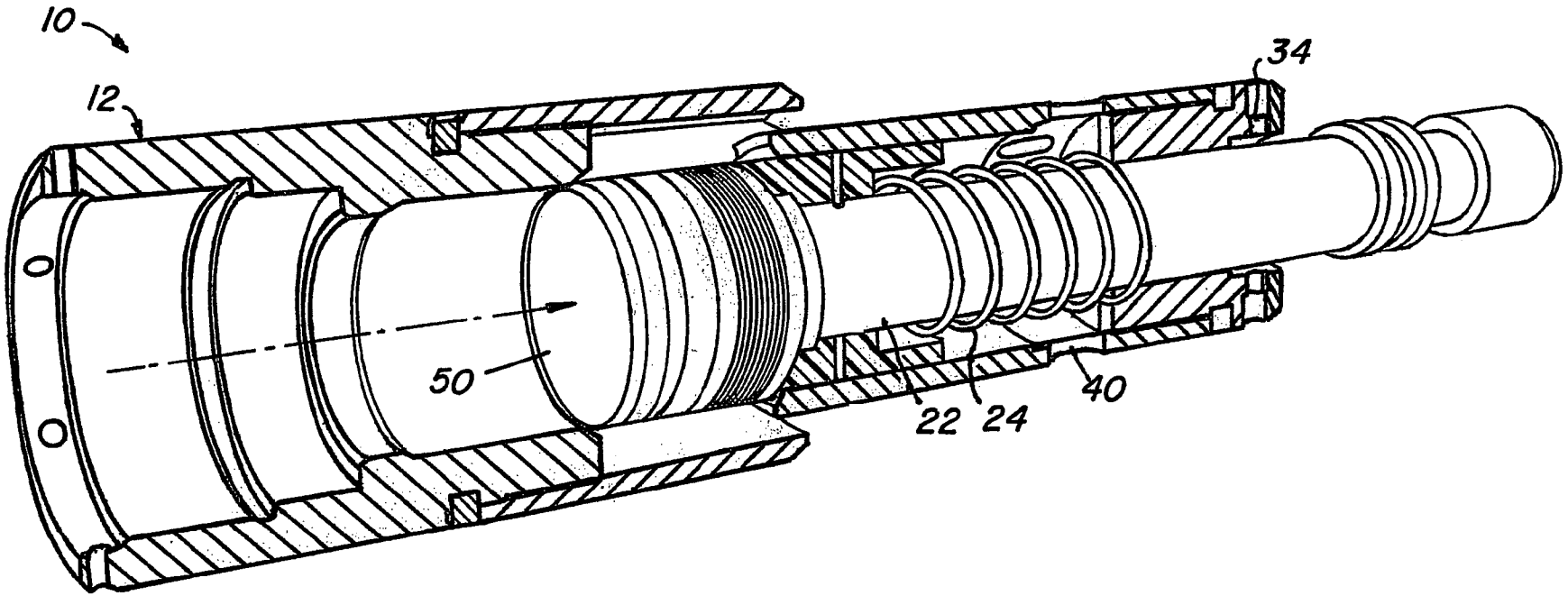
FIG. 4 is a partially cut-away perspective view of the valve of FIG. 1 in a partially open configuration.

Referring now to FIG. 4, there is shown a partially cut-away view of the valve of FIG. 1 in a partially open configuration. In this Figure, fluid pressure acting on the plug face 50 has increased sufficiently to overcome the combination of the pressure applied by the spring 24, the external well pressure and the force retaining the plug 22 in the run-in position by the shear screws 34. To get to this point, the shear screws 34 shear freeing the plug 22 to move in the direction of the arrow.

Figure 5:
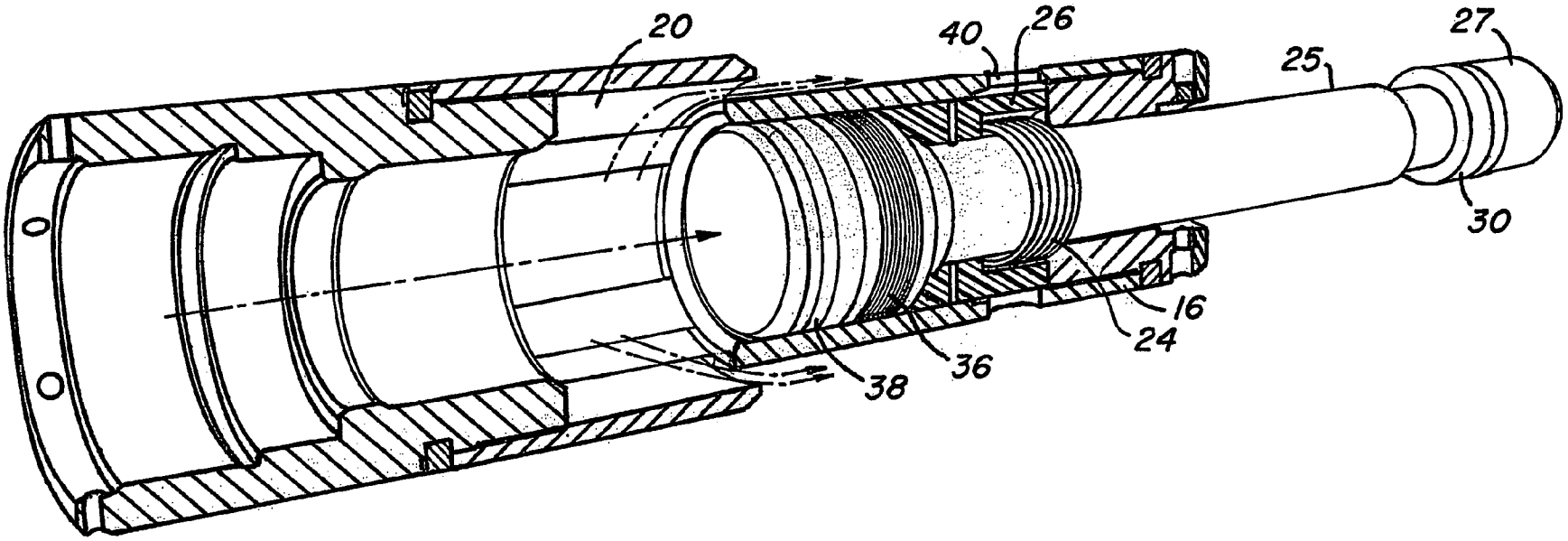
FIG. 5 is a partially cut-away perspective view of the valve of FIG. 1 in an open configuration.

FIG. 5 shows a partially cut-away perspective view of the valve 10 of FIG. 1 in an open configuration. In this configuration, the outlet ports 20 are fully open and fluid can flow through the outlet 20 in the direction indicated by the small arrows. The plug 22 is held in the open configuration by the fluid pressure, indicated by the large arrow.

The sacrificial shield 44 diverts the flow of fluid from the outlets 20 axially along the external surface of the lower housing portion 16. This prevents erosion of the surrounding bore casing (non-shown) and ensures that any erosion which occurs will take place on the sacrificial shields 44.

In this fully open configuration, it will be seen that the shear screw ring 30 has moved under gravity from the position shown in FIG. 3 to a position on which it is abutting the end cap 27. The purpose of this movement will be discussed in due course.

It will also be noted that the well fluid inlet ports 40 are covered by a lower end portion of the packing mandrel 26, preventing well fluids entering the lower housing portion 16 and acting on the plug 22.

When the plug 22 is in this open configuration, the wiper seal 38 and the V-packing seal 36 are contained within the lower housing portion 16. The lower housing portion 16 has a slightly larger internal bore than the upper housing portion 14 such that the V-packing seal 36 does not rub and wear on the internal surface of the lower housing portion 16. The wiper seal 38 does engage the lower housing portion 16 protecting the V-packing seal 36 from the injected fluid and any circulating debris.

Figure 6:
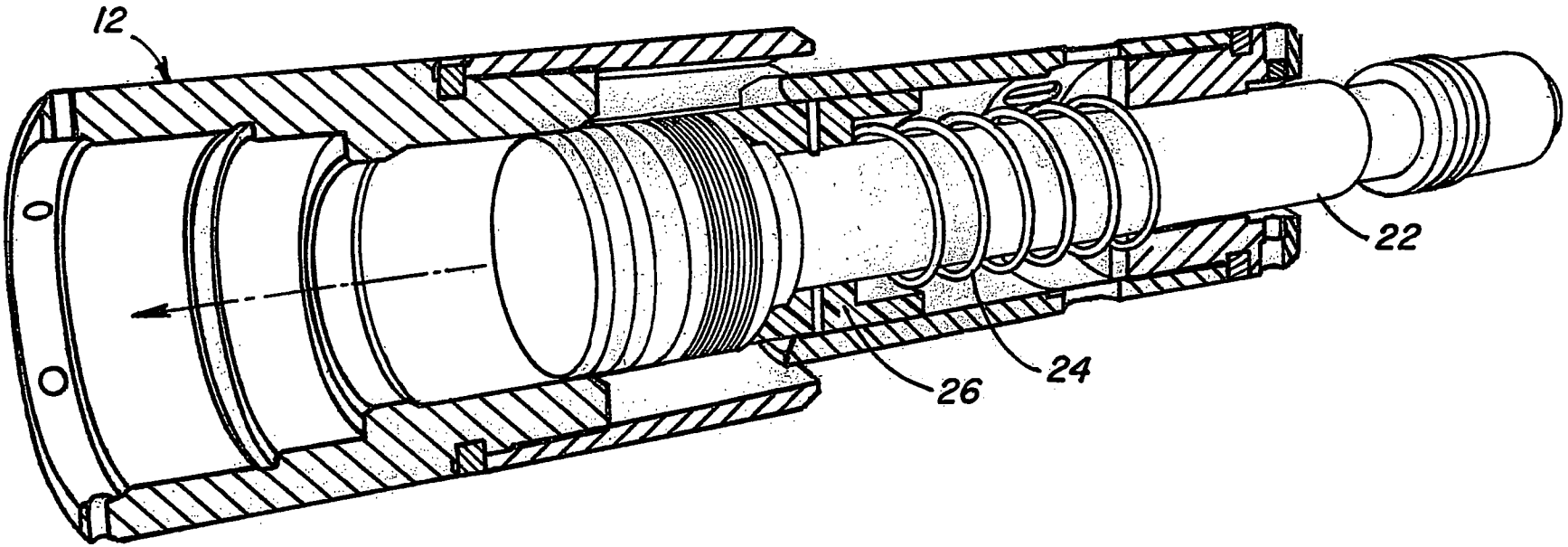
FIG. 6 is a partially cut-away perspective view of the valve of FIG. 1 in a partially sealed configuration.

Referring to FIG. 6, a partially cut-away perspective view of the valve of FIG. 1 in a partially sealed configuration. In this Figure, the pressure applied by the well fluid has been removed, and the plug 22 has moved in the direction of the arrow towards a partially sealed configuration under the action of the spring 24. The partially sealed configuration is better seen in FIG. 7, a partially cut-away side view of the valve 10 of FIG. 1 in the partially sealed configuration and FIG. 8 an enlarged close-up view of the seals and part of the housing 12 of FIG. 7.

Figure 7:
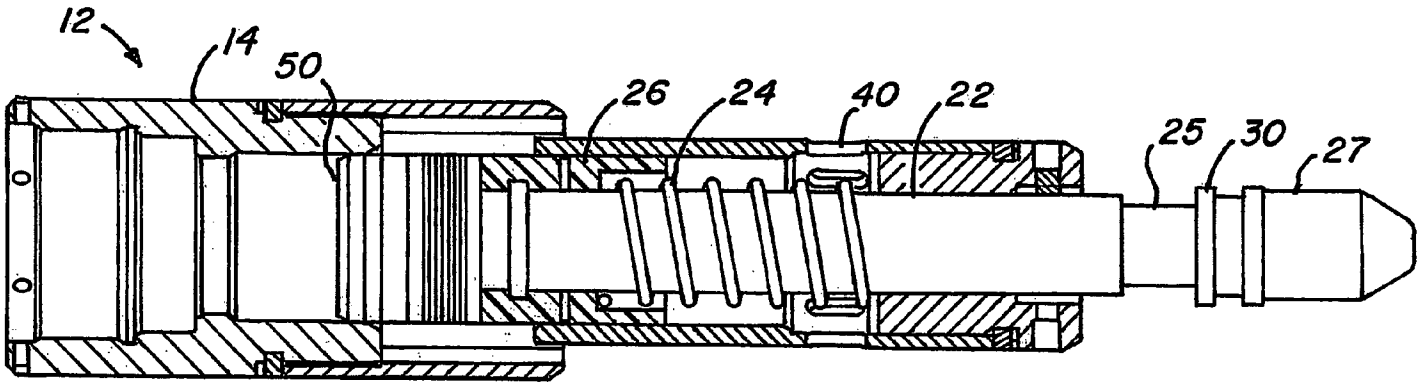
FIG. 7 is a partially cut-away side view of the valve of FIG. 1 in a partially sealed configuration.
Figure 8:
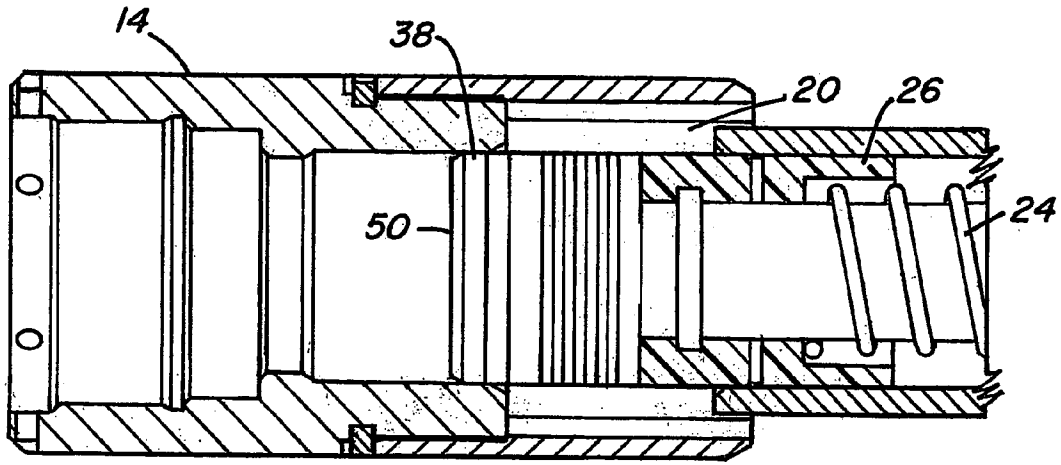
FIG. 8 is an enlarged closed-up view of the seals and part of the housing of FIG. 7.

Referring to FIGS. 7 and 8, it can be seen that in the partially sealed configuration, the plug 22 has been moved sufficiently by the spring 24 for the wiper seal 38 to engage the internal surface of the upper housing portion 14. In this configuration, the valve outlet 20 is sealed sufficiently by the wiper seal 38 to prevent ingress of well fluid and the well fluid inlet ports 40 (visible on FIG. 7) are no longer covered by the packing mandrel 26, permitting well fluid to enter the lower housing portion 16 and act on the packing mandrel 26.

Figure 9:
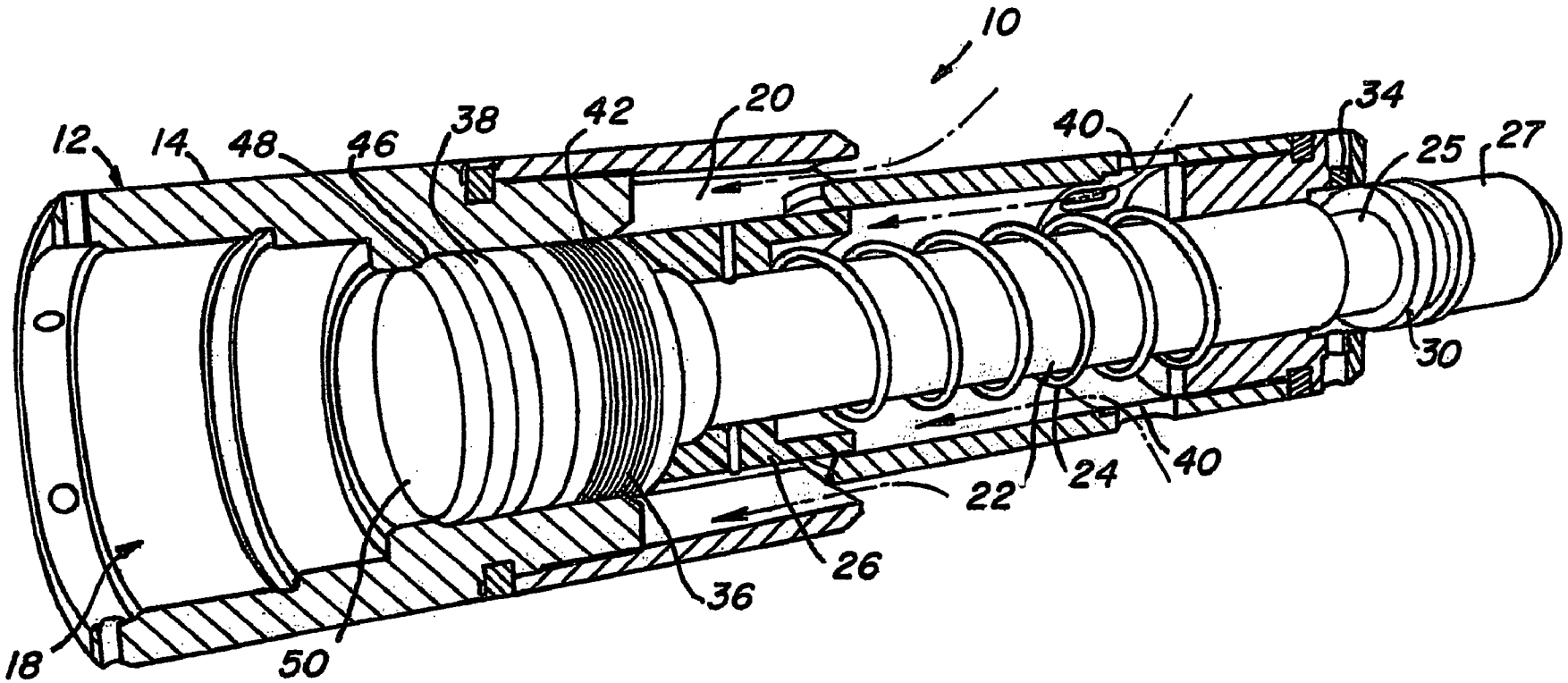
FIG. 9 is a partially cut-away perspective view of the valve of FIG. 1 in a fully sealed configuration.

FIG. 9 shows the plug 22 of FIG. 1 in the fully sealed configuration. The plug 22 has moved from the partially sealed configuration shown in FIGS. 7 and 8 to the fully sealed configuration shown in FIG. 9 by the action of well pressure. As indicated by the arrows, well fluid has entered the well fluid inlet ports 40 and the valve outlet 20 and is acting on the packing mandrel 26. In the absence of a counter pressure on the plug face 50, the well pressure is sufficient to move the plug 22 to the fully sealed configuration in which both the wiper seal 38 and the V-packing seal 36 are engaged with the upper housing portion internal surface 42, and the seal surface 46 is engaged with the seal seat 48.

As the plug 22 moves from the partially sealed configuration to the fully sealed configuration, the wiper seal 38 cleans the upper housing portion internal surface 42 ensuring a good seal is created between the internal surface 48 and the V-packing seal 36.

It can be also seen from FIG. 9 that the shear screw ring 30 has not re-entered the housing 12. This can be more clearly seen in FIG. 10.

Figure 10:
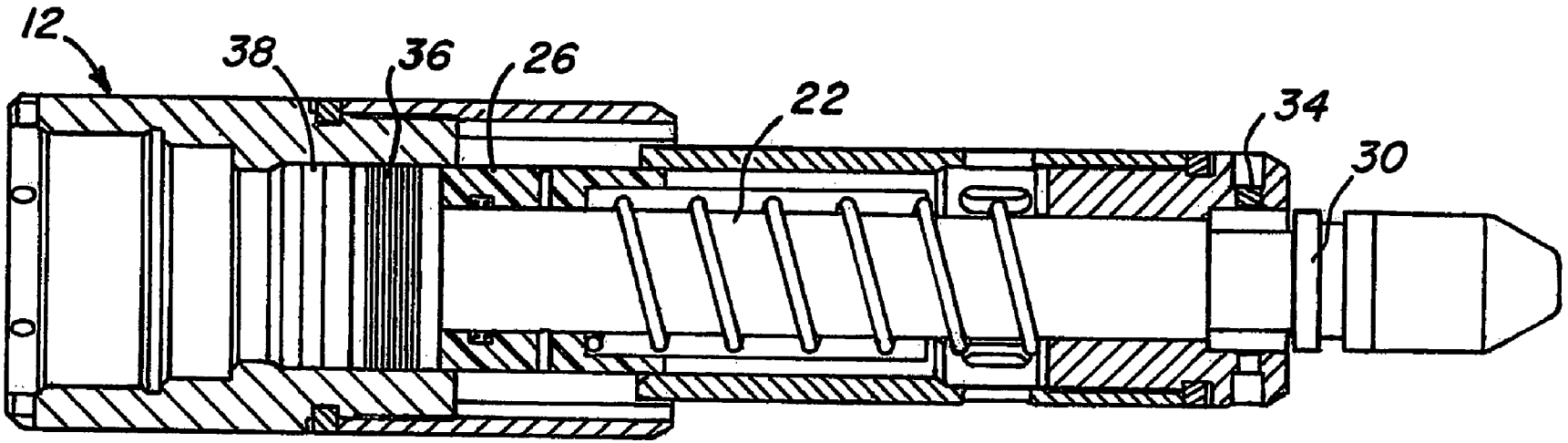
FIG. 10 shows a partially cut-away side view of the valve of FIG. 1 in a fully sealed configuration.

FIG. 10 shows a partially cut-away side view of the valve 10 of FIG. 1 in the fully sealed configuration. In this Figure the position of the shear screw ring 30 on the plug 22 outside of the housing 12 can most clearly be seen. This arrangement is adopted to prevent the stubs of the shear screws 34 fouling on the plug 22 as it moves to the fully sealed configuration. If the shear screws 34 did foul on the plug 22, which may occur if a moveable shear screw ring 30 was not used, the fouling may be sufficient to prevent the metal seal 44, the wiper seal 38 and the V-packing seals 36 from obtaining their optimum sealing position to fully seal the valve 10.

Various modifications may be made to the described embodiment without departing from the scope of the invention. For example, it will be understood that although the seal surface and the seal seat are shown machined respectively into the surface of the plug and the housing, they could equally be formed on separate elements which are inserted into the surface of the plug and/or the housing. Similarly, although the valve is shown with the sacrificial shields, these are not essential to the smooth running of the valve and could be omitted. Furthermore, the V-packing seals may be replaced with a Zertech™ Deformable Z-seal which could be energized due to the effect of piston and pressure differential.

Those of skill in the art will recognize that the above described embodiment of the invention provides a non-return valve which permits fluid to be injected into a downhole environment at a reduced pressure and with a reduced possibility of oscillation cycles being established within the valve.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A downhole non-return valve, comprising:

a first housing defining a valve inlet, a valve outlet, a housing bore and a shield perimetrically surrounding the housing bore at the valve outlet;

a plug having a first seal and a second seal, the plug being moveable between an open position, a partially sealed position, and a fully sealed position, the first seal sealingly engaged with the housing bore defining the partially sealed position, the first seal and the second seal sealingly engaged with the housing bore defining the fully sealed position, and neither the first seal nor the second seal sealingly engaged with the housing bore defining the open position;

a second housing engagable by a mandrel of the plug being configured to prevent fluids at well pressure from acting on the mandrel when the downhole non-return valve is in the open position while allowing fluids at well pressure to act on the mandrel when in the fully sealed position; and a biasing member urging the plug towards the fully sealed position wherein the urging force of the biasing member is sufficient to move the plug to the partially sealed position but is selected to be insufficient to move the plug to the fully sealed position.

2. The non-return valve of claim 1, wherein in the partially sealed position an outlet side of the plug is exposed to well pressure that aids in moving the plug to the fully sealed position.

3. The non-return valve of claim 1, wherein the shield is configured to redirect fluid flow from the outlet of the valve to substantially a longitudinal direction.

4. The non-return valve of claim 3, wherein the shield circumferentially surrounds the housing bore at the valve outlet.

5. The non-return valve of claim 1, wherein the biasing member is a spring.

6. The non-return valve of claim 1, further comprising:

a seal surface at the plug engagable with a seal seat at the first housing.

7. The non-return valve of claim 6, wherein the seal surface and seal seat are metal.

8. The non-return valve of claim 1, wherein the first seal is a wiper seal.

9. The non-return valve of claim 1, wherein the second seal is a V-packing seal.

10. The non-return valve of claim 1, further comprising:

run-in-configuration retainers that lock the plug in the fully sealed position during shipping, installation into the downhole environment, and initial pressure testing before releasing the plug from the run-in-configuration.

11. The non-return valve of claim 10, wherein the run-in-configuration retainers are releasable at a selected pressure.

12. The non-return valve of claim 10, wherein the run-in-configuration retainers are shear screws.

13. The non-return valve of claim 10, further comprising:

a ring receptive of the run-in-configuration retainers and movable relative to the plug, the ring configured to position the plug in the fully sealed position prior to release of the run-in-configuration retainers and to not restrict travel of the plug after release of the run-in-configuration retainers.

14. The non-return valve of claim 1, wherein the shield fully surrounds the valve outlet at the housing bore.

15. The non-return valve of claim 1, wherein the second housing has an inner bore engagably receptive to at least one of the first seal and the second seal when the plug is in the open position.

16. The non-return valve of claim 1, wherein the second housing includes ports configured to allow fluids to enter therethrough to act on the mandrel when the downhole non-return valve is in the fully sealed position.

17. The non-return valve of claim 16, wherein in the mandrel is configured to occlude fluid access through the ports when the downhole non-return valve is in the open position.

18. A method of injecting fluid into a well bore through a non-return valve, comprising:

porting fluids at well pressure to a portion of a plug when the non-return valve is in a fully sealed position;

injecting fluid into the non-return valve the valve being in the fully sealed position defined by a first seal disposed at a plug and a second seal disposed at the plug both being sealingly engaged with a housing bore;

pressurizing the fluid sufficiently to overcome a closing force comprising a combination of a biasing force and well pressure to open a valve outlet;

preventing fluids at well pressure from acting on the portion of the plug when the non-return valve is in the open position;

injecting fluid through the valve outlet into a well;

redirecting the fluid toward a substantially longitudinal direction; and ceasing injection of the fluid thereby permitting movement of the plug to a partially sealed position defined by sealing engagement of the housing bore with the first seal and not the second seal with the biasing force prior to fully sealing the valve outlet with the closing force.

19. The method of claim 18, further comprising:

cleaning the housing bore with the first seal prior to the second seal engaging the housing bore.

20. The method of claim 18, wherein the first seal is a wiper seal and the second seal is a V-packing seal.

21. The method of claim 18, further comprising:

shielding well bore components from fluid erosion with a sacrificial shield.

22. The method of claim 18, wherein the biasing force is provided by a biasing member.

23. The method of claim 18, further comprising engaging at least one of the first seal and the second seal in an inner bore of a second housing.

* * * * *